United States Patent [19]

Palnik

[11] Patent Number: 5,045,167

[45] Date of Patent: Sep. 3, 1991

[54] CONTINUOUS ELECTROPLATING APPARATUS

[75] Inventor: Karl L. Palnik, Huntingdon Valley, Pa.

[73] Assignee: The Carolinch Company, Ivyland, Pa.

[21] Appl. No.: 502,846

[22] Filed: Mar. 30, 1990

[51] Int. Cl.[5] ..... C25D 17/00

[52] U.S. Cl. ..... 204/206; 204/224 R

[58] Field of Search ..... 204/206, 224 R

[56] References Cited

U.S. PATENT DOCUMENTS

| | | | |
|---|---|---|---|
| 4,414,075 | 11/1983 | Cockeram | 204/206 |
| 4,431,500 | 2/1984 | Messing et al. | 204/206 |
| 4,452,684 | 6/1984 | Palnik | 204/206 |
| 4,610,772 | 9/1986 | Palnik | 204/206 |
| 4,818,349 | 4/1989 | Smith | 204/206 |

FOREIGN PATENT DOCUMENTS 0328186 8/1989 European Pat. Off. .

*Primary Examiner*—T. M. Tufariello

*Attorney, Agent, or Firm*—Charles J. Lindrooth

[57] ABSTRACT

Continuous spot plating, for example, of spots or separately defined regions of precious metals onto a metal substrate is disclosed. According to the disclosure, a multiplicity of plating heads are mounted for movement upon command on a rotating, endless belt or bandolier which is disposed adjacent to the path of travel of a moving strip of substrate metal, such as copper, on which the regions are to be plated. Sensing devices are mounted adjacent to the path of travel of the metal strip to detect and indicate the regions on the strip which are to be plated. The sensing of a region to be plated connects the next available plating head to the belt or bandolier for movement along a path in which the plating head is in contact with the region to be plated and moves at the same speed as the strip to effect electrolytic deposit of metal ions on the strip. Sufficient plating heads are provided so that a separate plating head is avaiable for activation to effect plating one each region requried to be plated. Control devices are provided to separately supply plating solution to each activated plating head and to complete the D.C. circuit which extends through an anode in the activated plating head, through the plating solution and the metal strip being plated. Once plating is accomplished, the particular plating head is deactivated and returned to a reserve position on the belt or bandolier for use as required.

18 Claims, 5 Drawing Sheets

CONTINUOUS ELECTROPLATING APPARATUS

FIELD OF THE INVENTION

This invention relates to the field of electroplating in general, and more particularly to method and apparatus for electroplating, selectively, discretely defined areas on metallic substrates which are preferably in continuous strip form. Although not limited thereto the preferred embodiment of the invention is directed to the plating of metal strip made, for example, of copper with spots of highly conductive metals, the plating metal being typically a precious or semi-precious metal which is electrolytically deposited in discrete regions or spots on the metal strip.

BACKGROUND AND PRIOR ART

Primarily because of the expense of the precious metals used in the fabrication of electronic components such as printed circuits and the like, extensive efforts have been made in recent years to confine the amount of plating metals used to the precise areas required and to recover plating solution for reutilization. In addition, there has been a need for plating on a continuous basis so as to reduce the time involved in the fabrication of micro-circuitry and, in as much as plating is one phase in the fabrication process which has not been susceptible to operation on a continuous basis, to provide continuous spot plating and thereby to appreciably reduce the overall amount of handling and processing time involved as compared with plating on a batch treatment basis.

Although strip plating on a continuous basis is known as shown in U.S. Pat. Nos. 4,431,550, 4,452,684 and 4,610,722, so far as the applicant is aware, effective apparatus for continuous spot plating on a moving substrate is unknown in the prior art.

SUMMARY OF THE INVENTION

According to the invention, plating in discrete regions (spot plating) on a continuous metal strip is accomplished by passing the strip through a plating station, providing at least one independently mounted plating head on an endless carrier which is moveable in a continuous path through the plating station. Each plating head is moved by the carrier through the plating station in synchronism with the strip in response to the presence of a region to be plated. Preferably, a plurality of plating heads are held at a reserve station spaced from the plating station for connection to the carrier on command. Control means responsive to a signal indicative of the presence of an area to be plated interconnect a plating head for movement from the reserve station through the plating station in synchronism with the metal strip and thereafter return the plating head to the reserve station where it is again held in reserve pending receipt of a control signal indicative of the approach of another region to be plated to the plating station. Plating may be accomplished on the fly precisely where required as the strip moves through the station.

According to the invention, each plating head contains a supply of plating solution and is provided with a masked surface having an opening in communication with the plating solution and defining a discrete region to be plated on the metal strip. As the plating head passes through the plating station, the masked opening is maintained in face-to-face substantially fluid-tight contact with the region to be plated. Circuit means make the metal strip cathodic with respect to the plating solution and establish a current path from an anode within each plating head, through the ions in the solution and the strip, in order to plate the masked area as the strip moves through the plating station. Preferably, a multiplicity of plating heads are mounted on the carrier and at least one head is available at the reserve station so that discrete areas can be plated on the strip at relatively small intervals. In addition, one or more masked openings may be present on each plating head. Alternatively, or in addition, a plurality of carriers spaced in tandem may be employed, thereby minimizing or varying the intervals between the plated regions. Different masks defining different shapes or sizes of shapes to be plated may be selectively mounted on the plating heads.

It is to be understood that before and after plating, the metal strip stock is subjected to various treatment steps including cleaning, activating, rinsing and drying as is known in the art. Post treatment, the strip stock is cut to desired length and used in the production of micro-electronic elements.

OBJECTS OF THE INVENTION

Based on the foregoing, an object of the invention is the provision of simple and effective means for continuously spot plating continuously fed metallic strip materials.

A related object is the provision of spot plating apparatus whose use substantially reduces material handling time required for the plating process.

Another object of the invention is the provision of spot plating equipment which effectively converts what has heretofore been a batch operation requiring close supervision and manual labor to a continuous operation wherein handling of the material being plated is avoided.

A still further object of the invention is the provision of spot plating apparatus which effectively confines the application of plating metal to a required area and allows for the ready recapture of used plating solution.

These and other objects and advantages of the invention will become apparent from the following detailed description of a preferred embodiment.

DESCRIPTION OF THE DRAWINGS

In the following detailed description, reference is made to the drawings in which:

FIG. 2 is a right sectional view through a

DESCRIPTION OF THE PREFERRED EMBODIMENT OF THE INVENTION

Figure 1:
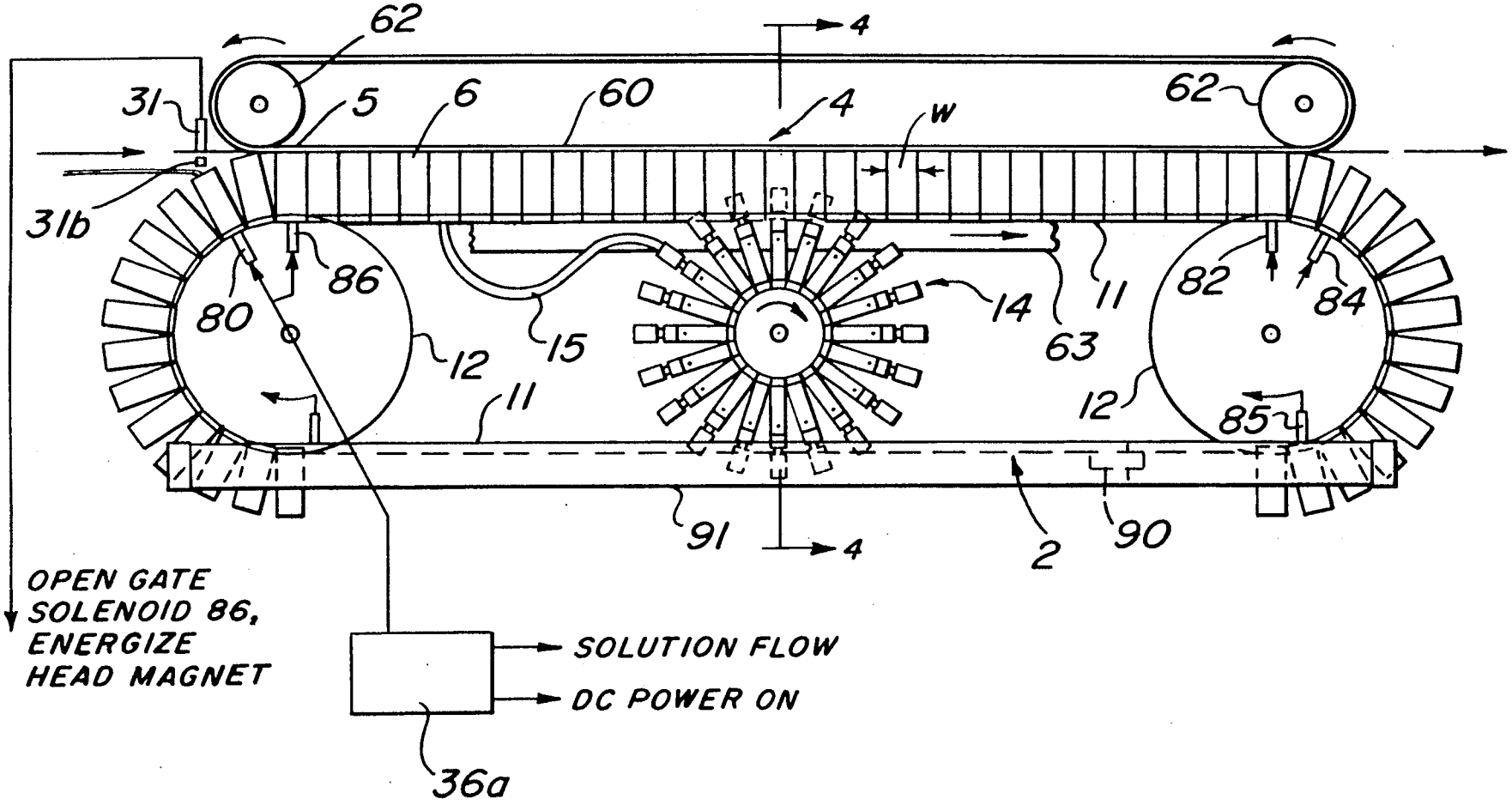
FIG. 1 is a plan view of plating apparatus formed according to the present invention.

With reference to the drawings and in particular to FIG. 1, a plan view of the preferred form of plating apparatus for spot plating on metal strip stock is shown which includes a moving carrier device generally indicated by the reference number 2. The carrier device 2 is mounted adjacent a plating station 4 through which metal strip stock 5 on which discrete regions are to be plated is continuously passed. A multiplicity of plating devices or heads 6, which are held for use on command, are moved through the plating station for the purpose of electrolytically depositing plating metal on the regions to be plated. As illustrated in FIG. 1, a number of plating heads are positioned at the left, adjacent to the entrance to the plating station where they serve as a reserve supply for use on demand, a number are passing through the plating station and a number have passed beyond the plating station where they await return to the reserve supply.

Although carrier device 2 may assume other forms, a preferred embodiment comprises an endless, flexible bandolier or belt 11, preferably formed of a ferrous metal for reasons explained hereinafter. Belt 11 is mounted on drive means comprised of a pair of wheels or rollers 12, one of which is driven by motor means not shown.

Belt or bandolier 11 supports a plurality of plating devices or heads 6, each of which is independently mounted on the bandolier and interconnectible thereto on command. Preferably, electromagnetic means individual to each head interconnects the head to the bandolier, as will be described; when not interconnected, the bandolier freely moves relative to the plating heads.

A preferred form of plating head 6 is shown in sectional view in FIG. 2 and will be described more fully hereinafter. Briefly stated, each head is connectible to the bandolier 11 independently of the other heads for movement with the bandolier in response to a signal indicative of the presence of a region to be plated on the metal strip stock. As the head moves through the plating station, it receives plating solution pumped through a rotating manifold 14 and its own flexible tube 15. Although each plating head is independently supplied with solution from the manifold 14 by its own flexible tube 15, only one tube 15 is shown in FIG. 1, the others being omitted to simplify the illustration.

Figure 3:
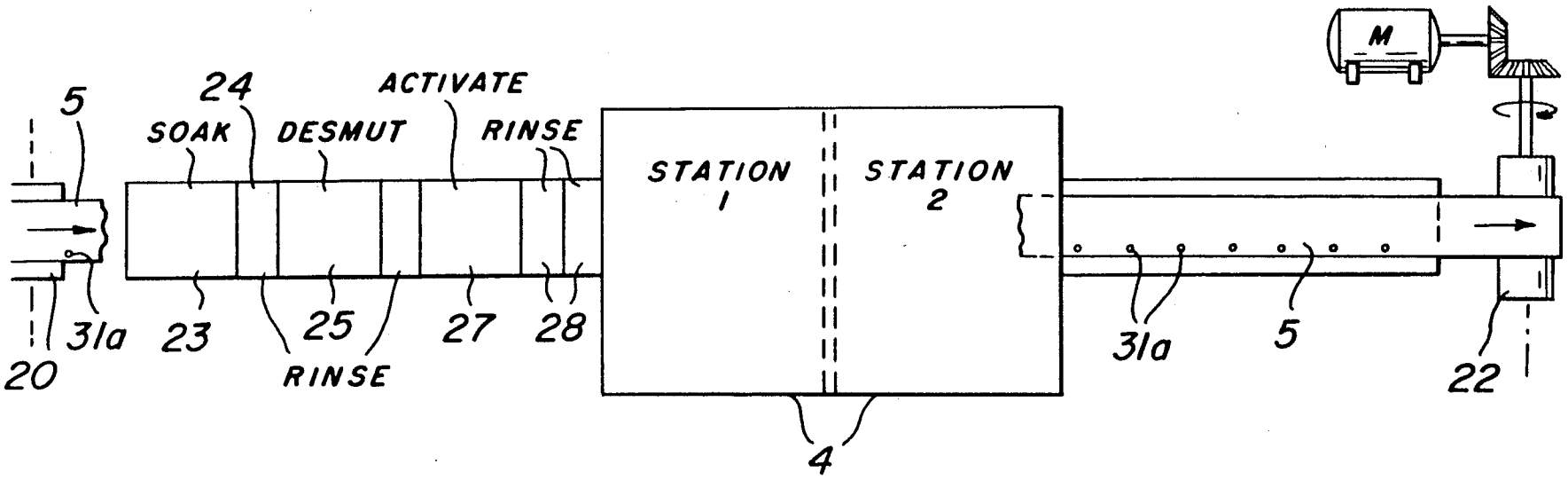
FIG. 3 is an overall schematic view illustrating a typical plating system incorporating the apparatus of FIGS. 1 and 2.

With reference now to FIG. 3, a side view of an overall plating system comprising the invention is schematically represented. The system of FIG. 3 includes a payoff reel 20 on which a supply of metal strip stock 5 to be plated is coiled and a take-up reel 22 which is driven by motor M to draw the strip stock through the system and to take up the plated strip. As will be understood by those skilled in the art, the metal strip stock is first subjected to various pretreatment steps in which the plate is soaked in an alkaline solution at 23, subjected to a cold water rinse at 24, desmutted at 25, rinsed at 26, activated with a mild acid at 27 and again rinsed with cold water at successive stations 28.

Thereafter, referring also to FIG. 1, the strip stock is drawn through first plating station 4. As the strip stock passes through the plating station, a location sensing device 31, located adjacent the entrance to the station, detects the presence of a region to be plated by sensing the presence of marker holes 31*a* (FIG. 3) or other coded indicia located on the margin of the strip stock in spaced predetermined relation to the areas to be plated. Although magnetic, mechanical or other sensing devices could be employed, location sensing device 31 is preferably a photo sensitive device which is responsive to the passage of light passing through each opening 31*a* in the strip stock from a light source 31*b* to generate a signal used to activate the next available plating head.

As indicated in FIG. 1, by way of example, a multiplicity of plating heads 6 are held in reserve on the bandolier 11 for use on demand. Upon receipt of a signal from sensing device 31, the next available head in the reserve supply, indicated by the reference character 6*a* in FIG. 1, is connected to the bandolier 11 and a gate is opened as will be described, so that the head is drawn by the bandolier through the plating station 4 in registration with the region to be plated on metal strip stock 5. As head 6 enters the plating station, it is connected to the positive terminal of a D.C. power supply and supplied with plating solution through manifold 14.

According to the invention, the strip material to be plated and the activated plating head are passed through the plating station at precisely the same linear speed, it being important that no relative movement occurs. To confine the plating solution to the area to be plated, each plating head is provided with a mask or face having an opening defining the region to be plated, which face is maintained in fluid tight relationship with the strip material. Plating solution passes through the mask opening and, because the strip material is connected to the negative terminal of the power supply, ions within the solution are electro-deposited on the strip portion of the material bounded by the masked opening. As can be understood from reference to FIGS. 1 and 2, as a plating head moves through the plating station 4, plating solution is continuously circulated from the manifold 14 through solution inlet tube 15, into a centrally located chamber 16 within the head. Partially spent solution is returned through flexible outlet tubing 18 to a tank not shown where it can be supplemented with fresh solution as required and eventually recirculated.

Referring again to FIG. 2 for a more detailed description of a plating head, each plating head 6 preferably comprises a carriage or base 32*a* which is mounted on bandolier 11 and is retained in position by a pair of mounting grooves 33 and 34. The groove 34 is conveniently formed by a removable retainer bar which is of angular cross section as shown at 35 and which is bolted or otherwise secured to the underside of the carriage or base. Removal of retainer bar 35 allows for separation of the individual head from the bandolier for repair or replacement as required.

The arrangement just described retains each plating head on the bandolier but allows for free relative movement of the bandolier except when a signal from sensing device 31 calls for movement of a plating head through the plating station as will be explained presently. As indicated above, means are provided for selectively connecting the plating head to the bandolier. Although other means may be employed, the illustrative embodiment of the invention uses an electromagnet 36 which is mounted within an annular recess 37 within the carriage or base 32*a* and which is energized upon receipt of a signal generated in response to the detection of a hole 31*a* by sensor 31.

Figure 2:
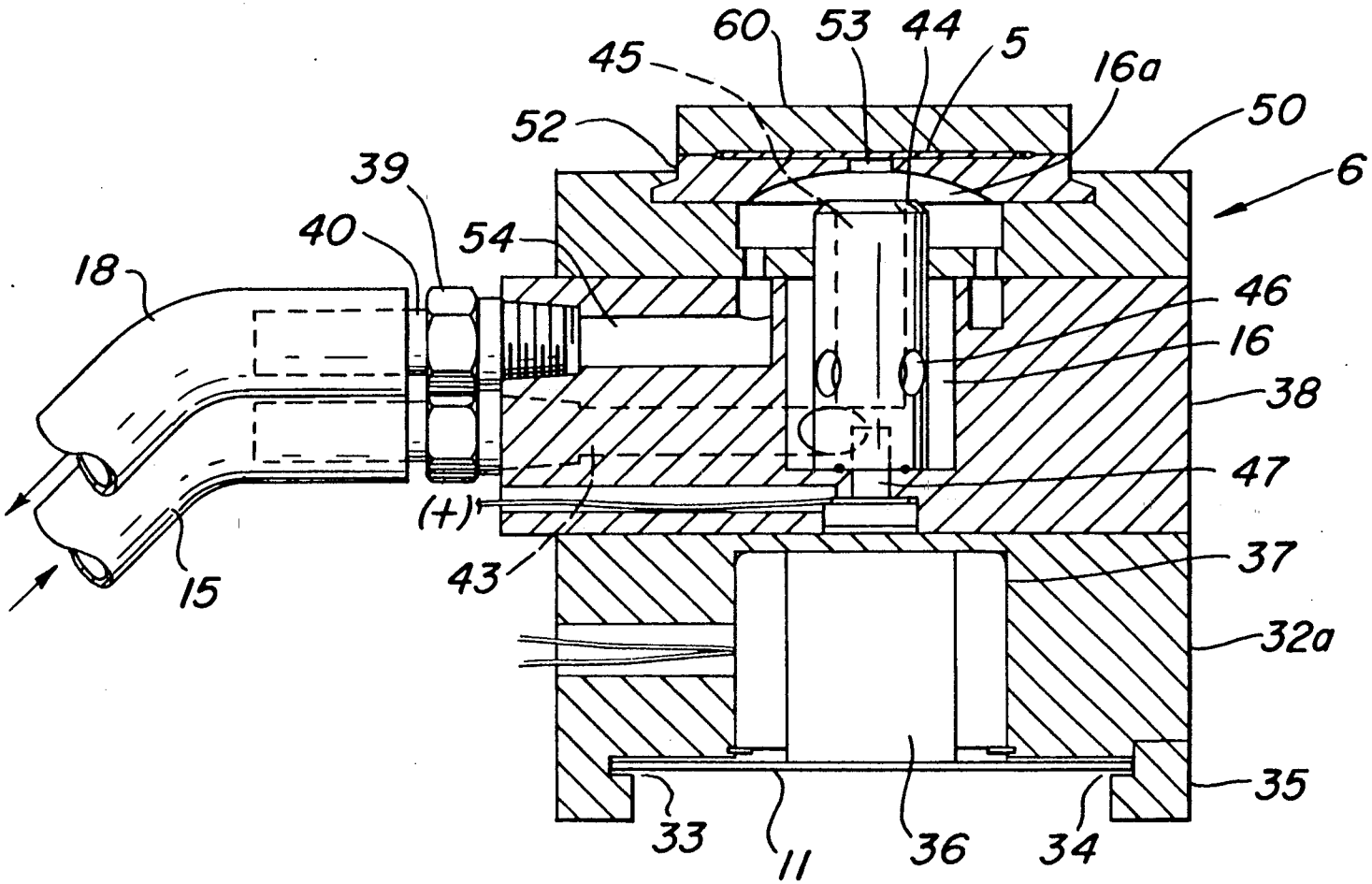

As illustrated in FIG. 2, the carriage or base 32*a* supports a hollow manifold block 38 having an inlet opening in which an inlet fitting 39 is securely fitted. Inlet fitting 39 connects to flexible inlet tube 15 in any suitable manner such as a threaded male coupling member 40 which connects on the end of the inlet tube. A plating solution flow path is thereby established into a central chamber portion 16 formed in manifold block 38 through a solution inlet passage 43. An anode 44 is mounted in the central portion 16. Although the anode 44 may assume various forms, a preferred form comprises a cylindrical element having an axial bore 45. Cylindrical anode 44 is mounted on the manifold block within chamber 16 and is provided with several radially extended passages 46 which provide communication between the chamber 16 and the bore 45. The anode 44 is mounted on an electrically conductive stud 47 which is electrically insulated from housing parts 32*a* and 38. A conductor 48 interconnects the stud with the positive terminal of a D.C. power source, not shown, the circuit being completed through the solution and the strip material to the negative terminal. The solution circulates from chamber 16 through the passages 46 and the bore 45 in intimate contact with the anode and thus is positively charged.

As can be seen in FIG. 2, the upper end of anode 44 projects into upper chamber 16*a* through a partition 49. Upper chamber 16 is defined by a mask support plate 50 which rests on the upper surfaces of manifold block 38. A pair of parallel mask retainer grooves 51 are formed at opposite sides of chamber 16*a* for the purpose of receiving and holding a front mask 52.

Front mask 52 has a central opening 53 which defines the region to be plated on the metal strip stock 5.

Front mask 52 may have one or more masked openings 53. Modification of the size, shape or pattern to be plated may be achieved by use of a plurality of interchangeable masks with differently shaped or sized openings. The modification may be achieved simply by slipping one mask out of the grooves 51 and replacing it with a mask having the desired opening or openings.

An outlet passageway 54 leads from upper chamber 16*a* to flexible outlet tube 18.

It may be seen from FIGS. 1 and 2 that a head 6 is passed through the plating station with the mask 52 in face-to-face contact with the region to be plated on the metal strip. Preferably, the plating station is provided with a rear support mask 60 in the form of an endless resilient belt which is mounted on drive means including a pair of wheels 62 one of which is driven at a speed which maintains the rear mask at the same speed as the metal strip stock and the plating head. The positioning of the rear mask and the resilience of the mask material should be such as to yieldingly maintain sufficient pressure on the metal strip to provide a fluid tight seal between the front mask and the metal strip. As can be seen in FIG. 2, the rear mask and the front mask extend beyond the side edges of the metal plate so as to further insure that no leakage of plating solution results. In addition, a bandolier support plate 63 is desirably positioned between wheels 12 opposite to the plating station to assure uniform contact between the masks and the stock as the plating heads move through the plating station.

Figure 4:
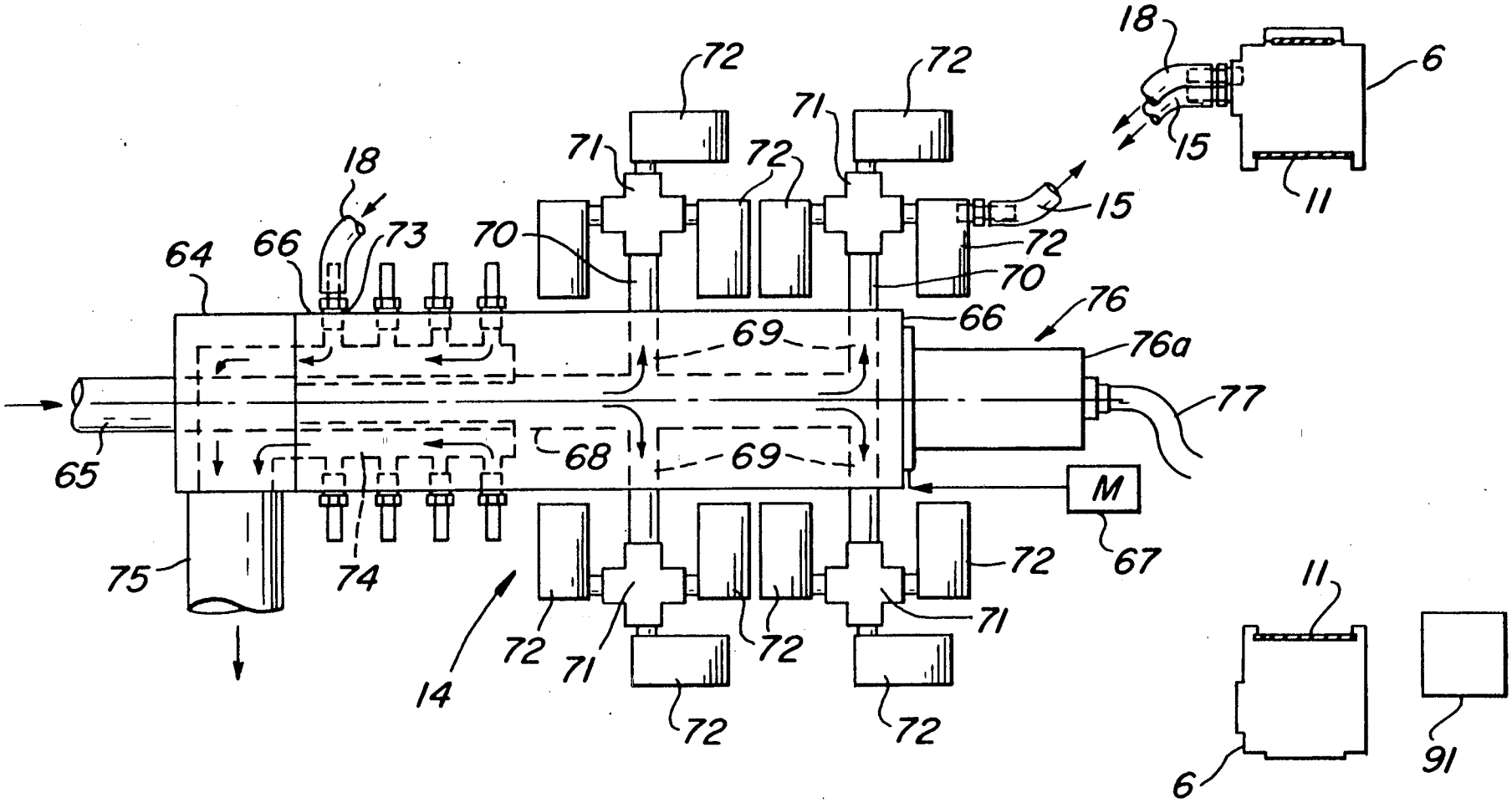
FIG. 4 is a partial sectional view taken on line 4—4 of FIG. 1.

With reference to FIG. 1 and FIG. 4, the plating solution manifold 14 is comprised of a stationary inlet section 64 (FIG. 4) and a tubular rotatable section 66 driven by a stepping motor schematically represented at 67. Motor 67 drives the rotatable section by any suitable means such as a belt drive and sprocket arrangement, not shown.

Rotatable tubular section 66 has an annular passage 68 extending lengthwise thereof. The passage 68 is supplied with electrolyte solution from a source of supply including supply conduit 65, through stationary manifold section 64. Radiating internal passages 69 extend from annual passage 68 to ports on the periphery of rotary section 66.

An outwardly extending tube 70 is fitted within the port of each radial passage 69. As can be seen in FIG. 4, one branched passage of 4-way pipe fitting 71 is connected to each tube 70. The remaining branched passages each supply solution to the inlet of a solenoid operated valve 72, each of which controls the supply of electrolyte solution to the flexible tube 18 associated with one of the plating heads 6.

In the illustrative embodiment of &he invention wherein each of 20 radiating tubes 70 supplies electrolyte to the inlets of three solenoid operated valves a total of 60 heads 6 are controllably supplied with electrolyte solution.

As indicated above, the rotating manifold section is driven by stepper motor 67, the motor serving to maintain the movement of the manifold in a synchronized relationship with the movement of heads 6.

In order to supply D.C. power to the plating heads and to complete circuits to the solenoids for the valves 72 and the electromagnets 36, a rotary contact member 76 is bolted to the end of rotating manifold member 66. A Meridian Laboratory Model MX or MXT "rotocon" rotary contact member may be employed to provide individual electrical contact between the conductors within non-rotatable cable 77 and conductors within rotatable section 76*a*, the conductors within the latter being individually connected to the solenoids the electromagnets 36 or the anodes 44.

Used plating solution is preferably returned from each plating head 6 through the rotating mandrel section. The flexible return conduit 18 for each head is fixed within a port 73 in the rotating manifold section. Passage means 74 leads from each port through the rotating and fixed sections 66, 65 to a return pipe 75 from which spent solution is collected.

It will be apparent that, at a single plating station as in the illustrative embodiment of the invention, there is a limitation on the minimum possible distance between plated regions which is equal to the width of a plating head. As shown in FIG. 3, the provision of a pair of plating stations in tandem effectively reduces this dimension by the plating of every other region at the second plating station.

Figure 5:
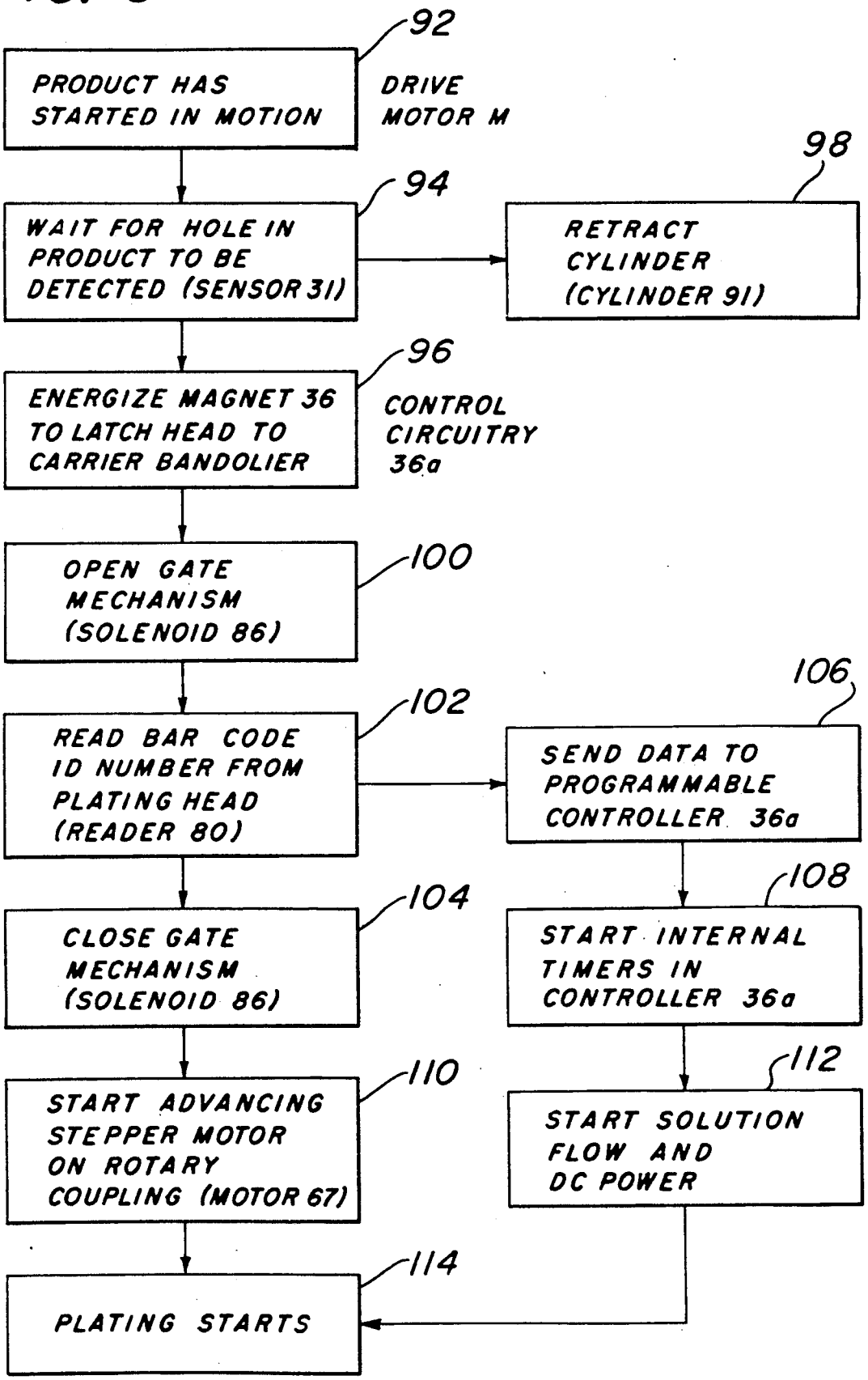
FIG. 5 is a flow diagram illustrating the sequence of operations of various control mechanisms incorporated in the preferred embodiment of the invention.

Control means for continuous operation of the apparatus will now be described with particular reference to FIGS. 1, 4 and 5. Referring first to FIG. 1, various position sensors are disposed along the path of travel of strip stock 5 and the heads 6. These sensors preferably consist of location sensor 31 which senses the presence of location on the strip stock requiring plating. A first head I.D. sensor 80 is provided at the entrance to the plating station and preferably is a bar code reader which reads a bar code imprinted on and individual to each head to detect which particular head is at the entrance to the plating station. A second head I.D. sensor 82 is disposed at the exit to the plating station and reads the bar codes individual to the heads for detecting when a particular head is exiting the plating station. A third head sensor 84 is provided downstream from the plating station exit and provides an end of travel signal used to deenergize the electromagnet 36 for the particular head thereby releasing the head from conjoint movement with the belt 11.

The control means further desirably comprises a solenoid operated brake or gate 86 positioned at the entrance to the plating station. Gate 86 serves to prevent premature movement of heads at the entrance to the plating station to assure precise registration of heads with regions to be plated.

The preferred embodiment preferably also comprises a reciprocating escapement type pick-up device schematically represented at 90 driven by an elongated air cylinder 91. Upon detection of a plating head by a forth I.D. sensor 85, pick up device 90 is stroked to move the head to the left of FIG. 1 and immediately returns to the right for pick up and return of the next head upon receipt of a new signal from the I.D. sensor.

FIG. 4 illustrates in a schematic flow diagram, the sequence of operation of the various elements of the invention. Starting with block 92, motion of strip stock 5 is started by energizing motor M (FIG. 3). Location sensor 31, upon detection of the presence of a hole in the border of strip stock 5, as is indicated by block 94, effects energization of magnet 36 to magnetically latch the next available plating head to the belt 11 via programmable machine controller 36*a* of a type commercially available, for example from General Electric or Hewlett Packard, (block 96) and cylinder 91 is retracted to position to pick up a head 6 upon receipt of a signal from sensor 85 (block 98). Brake solenoid 86 (block 100) is simultaneously energized which releases the head at the entrance of the plating station for movement through the plating station. First head I.D. sensor 80 reads the bar code for the released head (block 102) which effects closure of the gate 86 (block 104) and sends the head I.D. number for the released head to the controller 36*a*.

Data sent to the programmable controller indicative of the I.D. number for the particular plating head (block 102) initiates internal timers within the controller (blocks 106 and 108) to start solution flow (block 112) by opening the appropriate solenoid operated valve 72 for the plating head identified and independently complete the D.C. power circuit for the particular plating head. The timers within the controller are preset to maintain solution flow and D.C. power on during passage of the head through the plating station. Bar code reader 80 at this time also deenergizes gate solenoid 86 to assure that the next available plating head is in the proper position (block 104). Simultaneously, stepper motor 67 initiates stepwise movement of the rotating manifold section 66 (block 110).

Plating is now effected on the selected spot on strip stock 5 as the identified plating head moves through the plating station (block 114). When the head is detected by second head I.D. sensor 82, second head I.D. sensor signals the programmable controller to deenergize the magnet coil attaching head to the bandolier. The head continues movement until detected by third head sensor 85 which energizes the air cylinder to return the head to the reserve supply.

In FIG. 1, a multiplicity of plating heads will be simultaneously effecting plating as they move through the plating station and another group of plating heads will have moved out of the plating station, will not be receiving plating solution due to deenergization of the solenoid operated valve with which they are associated and will be returned to the reserve station in sequence as each head at the entrance of the plating station is released.

In summary, negatively charged metal strip stock is continuously fed off a pay-off roll 20 and drawn through the plating station 4 by a driven take-up roll 22. Registration sensor 31 detects the approach of regions to be plated on the strip stock 5 and energizes the solenoid 36 of the next available plating head 6, thereby electromagnetically connecting the plating head to the ferrous rotating bandolier 11. The solenoid latches in the energized condition so that the plating head is drawn through the plating station and is thereafter returned to a position adjacent the entrance to the plating station where the solenoid is deenergized and the head held in reserve until its solenoid is reenergized. As any given plating head enters the plating station, plating solution is pumped to that head, through the flexible tube 15 associated with that particular plating head. The plating solution passes through passage 43, through the interior of anode ring 44 where the metal ions are charged. The charged solution contacts the region of the metal strip to be plated and the metal ions are deposited in the region of the strip within the mask, the strip being negatively charged to complete the plating circuit. Used solution flows outwardly through flexible tube 18 to a reservoir or tank, not shown, where the spent metal ion is replenished and the replenished solution available for recirculation.

During passage through the plating station, the resilient rear mask and the bandolier support 63 maintain a fluid tight contact between front mask 52 and the strip stock 5, thereby assuring that only the exposed surface on the stock defined by the mask is plated. During the plating operation, it is important that the plating heads, the stock 5 and the rear mask are driven in unison so as to insure that no slippage results which could lead to loss of definition and inadequate plating of the region to be plated.

It can be appreciated that considerable variation in the interval between areas to be plated may be provided using the apparatus of the invention. With the plating equipment shown in FIG. 1, the minimum interval is dictated by the width "w" of each plating head. However, the invention contemplates plating at still smaller intervals by the positioning of plating stations in tandem. In the schematic representation of the invention shown in FIG. 3, two such plating stations, each comprised of a separate set of apparatuses of the kind shown in FIG. 1, are provided to effectively halve the interval between regions to be plated.

The invention provides for much higher production rates in the plating of discrete regions on metallic stock used for microprocessor substrates or the like than has heretofore been possible. Since plating is confined to a sharply defined area and since plating solution can be continuously recovered and revised, loss of the precious metal constituent of the solution is minimized. Various plating intervals, shapes and patterns may be readily provided by the substitution of one mask for another. Plating interval can be readily varied as desired.

I claim:

1. An electroplating apparatus comprising:

a carrier moveable in a continuous path;

a product plating station located along a first portion of the path of said carrier, whereby metallic stock in strip form is plated;

means for continuously moving negatively charged stock in strip form along the portion of said path through said plating station;

at least one plating head comprising a reservoir of plating solution, an anode in said reservoir for positively charging the solution relatively to said stock and a masked plating orifice for application of plating solution through the orifice to said stock;

means mounting said head on said carrier for independent movement of the carrier relative to the head, said mounting means further comprising selectively operable means activatible to interconnect the head and the carrier for conjoint movement;

control means including a product sensing means responsive to the presence of a region to be plated on said stock for activating said selectively operable means for conjoint movement of the head and the carrier through the plating station; and means for maintaining the masked orifice and the stock in contact through said plating station, whereby the area defined by the mask is plated;

said control means further including means for thereafter deactivating said selectively operable means to disconnect the head from the carrier.

2. Apparatus according to claim 1 further including a multiplicity of plating heads mounted on said carrier means, the number of heads being sufficient to maintain a reserve supply of said plating heads at the entrance to said plating station;

said control means including head identification means operative to activate the selectively operable means to connect the head next adjacent to said plating station to the carrier.

3. Apparatus according to claim 2 further including an electroplating solution supply means for supply of electroplating solution to each of said electroplating heads, said control means further including means for interconnecting said solution supply means to each said plating head as the plating head enters the plating station.

4. Apparatus according to claim 3 wherein said control means further includes means for disconnecting said solution supply means from each said plating head as the said plating head leaves the plating station.

5. Apparatus according to claim 4 wherein said electroplating solution supply means comprises a stationary inlet section having a supply passage for supply of solution and a rotatable section having a plurality of outlet passages, said outlet passages having exit portions radially spaced from the axis of rotation of the rotating section, each of said outlet passages providing fluid communication from said supply passage to one of said plating heads, motor means for rotating said rotatable section to maintain said exit portions of coordinated predetermined special relationships between the outlet passages and the plating heads.

6. Apparatus according to claim 5 wherein each said outlet passage includes a flexible conduit portion connected to a said plating head said flexible conduit section being located externally of said rotatable section, said flexible conduit portion allowing for movement of the plating heads relatively to the rotating section.

7. Apparatus according to claim 6 further including electrically operated valve means for each of said outlet passages, and further wherein said valve means is operated by said control means to open the outlet passage when the plating head enters the plating station and to close the outlet passage when the plating head leaves the plating station.

8. Apparatus according to claim 7 wherein said control means includes D.C. circuit means associated with said fluid supply means and providing an individual circuit path to each said plating head, said circuit means including means to connect the anode in each plating head to the power supply when the head enters the plating station and to disconnect the anode when the head leaves the plating station.

9. Apparatus according to claim 1 further including gate means for blocking movement of a head at the entrance to said plating station and wherein said control means includes means for opening said gate means in response to the sensing of an area to be plated by said sensing means.

10. An electroplating apparatus for the application of electrolytic plating solution to separate, discretely defined regions on a continuous metal substrate to be plated, said apparatus comprising:

a carrier moveable in a continuous path:

a multiplicity of plating heads, mounted on said carrier, said mounting means permitting independent movement of the carrier in said continuous path, said plating heads each containing a supply of plating solution and having a surface with an insulating mask having an opening therein, said opening being in communication with the supply of plating solution, said opening defining the area to be plated on the substrate;

a plating station located adjacent a first region of said continuous path;

a holding station on said continuous path spaced from said plating station, the number of plating heads being sufficient to maintain at least one of said plating heads in reserve at said holding station; the plating station in synchronism with the carrier with the regions to be plated being in the plane of the masked opening on said plating head;

substrate responsive control means operable in response to the presence of a region to be plated on said substrate for activating said control means to connect the next plating head at said holding station to the carrier, each said plating head being movable by the carrier with the masked opening in face-to-face substantially fluid-tight contact with the region to be plated on the substrate; and means establishing a current path through the plating solution and the substrate, including means for rendering said substrate cathodic with respect to the solution, for the deposit of plating metal from the solution onto the discretely defined region of the substrate when the masked opening and the region to be plated are in said face-to-face contact.

11. Apparatus according to claim 10 including means for replenishing the supply of plating solution in each said plating head comprising a stationary inlet section having a supply passage for supply of solution and a rotatable section having a plurality of outlet passages, each of said outlet passages providing fluid communication from said supply passage to one of said plating heads, motor means for rotating said rotatable section to maintain a coordinated predetermined special relationship between the outlet passages and the plating heads.

12. Apparatus according to claim 11 wherein said outlet passage includes a flexible conduit portion connected to a said plating head, said flexible conduit section being located externally of said rotatable section, said flexible conduit portion allowing for movement of the plating heads relatively to the rotating section.

13. Electroplating apparatus for application of plating solution to separate discretely defined regions of a metal strip, said apparatus comprising:

a plating station at which the discretely defined regions of said metal strip are plated, said plating station having an entrance and an exit through which said metal strip is passed;

means for moving the metal strip through the plating station;

an endless carrier device moveable in a continuous path including said plating station;

a plurality of plating heads on said carrier device, means mounting said plating heads for independent movement of the carrier device in said endless path, said mounting means including control means for interconnecting the plating heads selectively with said carrier device whereby a plating head is moved through said continuous path concurrently with said carrier;

each said plating head containing a supply of plating solution and having a plating surface with an insulating mask thereon, said mask having an opening in communication with the plating solution and defining a discrete region to be plated on the substrate;

a holding station at the entrance to the plating station for maintaining a plating head for use on demand;

drive means for moving the substrate through the plating station in synchronism with the carrier;

position responsive means operable in response to the presence of a region to be plated on the metal strip for activating said control means to interconnect the next available plating head at said holding station to the carrier, said plating head being moveable by the carrier at a velocity equal to the velocity of the strip with the masked opening in face-to-face substantially fluid-tight contact with the region to be plated on the strip; and means establishing a current path through the plating solution and the metal strip, including means for rendering the substrate cathodic with respect to the solution.

14. Apparatus according to claim 13 wherein said electroplating solution supply means comprises a stationary inlet section having a supply passage for supply of solution and a rotatable section having a plurality of outlet passages, each of said outlet passages providing fluid communication from said supply passage to one of said plating heads, motor means for rotating said rotatable section to maintain a coordinated predetermined special relationship between the outlet passages and the plating heads.

15. Apparatus according to claim 14 wherein each outlet passage includes a flexible conduit portion connected to a said plating head, said flexible conduit section being located externally of said rotatable section, said flexible conduit portion allowing for movement of the plating heads relatively to the rotating section.

16. An electroplating apparatus comprising:

a carrier moveable in an endless path;

a product plating station located along a first portion of the path of said carrier, whereby metallic stock in strip form is plated;

means for continuously moving negatively charged stock in strip form along the portion of said path through said plating station;

a plurality of plating heads on said carrier, each of said heads comprising a reservoir of plating solution, an anode in said reservoir for positively charging the solution relatively to said stock and a masked plating orifice for application of plating solution through the orifice to said stock;

control means including a product sensing means responsive to the presence of a region to be plated on said stock for means for maintaining the masked orifice and the stock in contact through said plating station, whereby the area defined by the mask is plated;

an electroplating solution supply means for supply of electroplating solution to each of said electroplating heads, said control means further including means for interconnecting said solution supply means to each said plating head as the plating head enters the plating station and for disconnecting said solution supply means from each said plating head as the said plating head leaves the plating station.

17. Apparatus according to claim 16 wherein said electroplating solution supply means comprises a stationary inlet section having a supply passage for supply of solution and a rotatable section having a plurality of outlet passages, each of said outlet passages providing fluid communication from said supply passage to one of said plating heads, motor means for rotating said rotatable section to maintain a coordinated predetermined special relationship between the passages and the plating heads.

18. Apparatus according to claim 17 wherein each said outlet passage includes a flexible conduit portion connected to a said plating head, said flexible conduit section located externally of said rotatable section, said flexible conduit portion allowing for movement of the plating heads relatively to the rotating section.

* * * * *

UNITED STATES PATENT AND TRADEMARK OFFICE

CERTIFICATE OF CORRECTION

PATENT NO. : 5,045,167

DATED : September 3, 1991

INVENTOR(S) : Karl Palnik

It is certified that error appears in the above-identified patent and that said Letters Patent is hereby corrected as shown below:

Title page of Patent--Inventor's name is incorrect. Change "Karl L. Palnik" to --Karl Palnik--

Title page of Patent--Attorney, Firm or Agent is incorrectly spelled. Change "Charles J. Lindrooth" to --Charles H. Lindrooth--

In the Claims, column 9, line 52, after "head" insert --,--

In the Claims, column 10, line 13, ":" should be --;--

In the Claims, column 10, line 28, after "station;" start new paragraph and add --drive means for moving of the substrate through--

Column 2, line 52, the sentence has not been completed. After "FIG. 2 is a right sectional view through a" insert --typical plating head, taken on line 2-2 of FIG. 1;--

Column 4, line 7, after "opened" insert --,--

Column 5, line 40, after "wheels 62" insert --,--

Column 6, line 9, change "&he" to --the--

Column 6, line 27, after "solenoids" insert --,--

UNITED STATES PATENT AND TRADEMARK OFFICE

CERTIFICATE OF CORRECTION

PATENT NO. : 5,046,167

DATED : September 3, 1991

INVENTOR(S) : Karl Palnik

It is certified that error appears in the above-identified patent and that said Letters Patent is hereby corrected as shown below:

Column 6, line 27, after" solenoids" insert --,--

Signed and Sealed this

Second Day of February, 1993

*Attest:*

STEPHEN G. KUNIN

*Attesting Officer*

*Acting Commissioner of Patents and Trademarks*